US011585638B1

(12) United States Patent
Gagnon, Jr.

(10) Patent No.: US 11,585,638 B1
(45) **Date of Patent: *Feb. 21, 2023**

(54) COMBAT HELMET HAVING FORCE IMPACT DISTRIBUTION

(71) Applicant: Dennis P Gagnon, Jr., Miramar Beach, FL (US)

(72) Inventor: Dennis P Gagnon, Jr., Miramar Beach, FL (US)

( * ) Notice: Subject to any disclaimer, the term of this patent is extended or adjusted under 35 U.S.C. 154(b) by 293 days.

This patent is subject to a terminal disclaimer.

(21) Appl. No.: 16/889,922

(22) Filed: Jun. 2, 2020

Related U.S. Application Data

(63) Continuation-in-part of application No. 15/844,582, filed on Dec. 17, 2017, now Pat. No. 10,667,572, which is a continuation-in-part of application No. 14/725,817, filed on May 29, 2015, now abandoned.

(51) Int. Cl.
*F41H 1/08* (2006.01)
*A42B 3/08* (2006.01)
*A42B 3/06* (2006.01)

(52) U.S. Cl.
CPC ..... *F41H 1/08* (2013.01); *A42B 3/06* (2013.01); *A42B 3/08* (2013.01)

(58) Field of Classification Search
CPC ..... A42B 3/06; A42B 3/065; A42B 3/08
See application file for complete search history.

(56) References Cited

U.S. PATENT DOCUMENTS

D281,031 S * 10/1985 Gilligan ..... D2/882
4,564,959 A * 1/1986 Zahn ..... A42B 3/0493 2/184.5
4,778,638 A * 10/1988 White ..... B29C 70/345 264/153
4,908,877 A * 3/1990 White ..... F41H 1/08 2/6.6
D314,271 S * 2/1991 Huegy ..... D2/882
5,561,866 A * 10/1996 Ross ..... A42B 3/124 D29/102
6,260,212 B1 * 7/2001 Orotelli ..... A42B 3/06 2/5
6,363,539 B2 * 4/2002 Tachi ..... F41H 1/04 2/412
6,969,548 B1 * 11/2005 Goldfine ..... A41D 13/015 264/46.7
D669,638 S * 10/2012 Martinez ..... D29/102
8,353,066 B2 * 1/2013 Rogers ..... A42B 3/08 2/419
9,332,800 B2 * 5/2016 Brown ..... A42B 3/122
D782,117 S * 3/2017 Gobbi ..... D29/106
D788,413 S * 6/2017 Moore ..... D2/882
9,693,594 B1 * 7/2017 Castro ..... A63B 71/10
9,717,297 B2 * 8/2017 Harris ..... A42B 3/121
(Continued)

*Primary Examiner* — F Griffin Hall
(74) *Attorney, Agent, or Firm* — Peter Loffler

(57) ABSTRACT

A combat helmet has a shell made from a ballistic rated material, the shell having an outer surface and an inner surface such that at least a portion of the outer surface is formed as a series of adjoining polygon shaped faceted regions that help distribute any force impacted on such regions across a relatively large portion of the shell. The faceted regions are curvedly contoured, and may extend through to the inner surface of the shell. The faceted regions may cover primarily the crown section of the helmet shell, the lower section, or both.

18 Claims, 3 Drawing Sheets

(56) References Cited

U.S. PATENT DOCUMENTS

| | | | | |
|---|---|---|---|---|
| D858,894 | S * | 9/2019 | Bayer | D29/102 |
| 10,667,572 | B1 * | 6/2020 | Gagnon, Jr. | A42B 3/065 |
| D907,858 | S * | 1/2021 | Hall | D29/102 |
| 11,134,738 | B2 * | 10/2021 | Grice | A42B 3/069 |
| 11,229,254 | B1 * | 1/2022 | Matteucci | A42B 3/20 |
| 2011/0145981 | A1 * | 6/2011 | Teetzel | G02B 23/125 2/422 |
| 2011/0203024 | A1 * | 8/2011 | Morgan | F41H 1/04 2/2.5 |
| 2012/0047634 | A1 * | 3/2012 | Vaidya | B29B 9/06 525/432 |
| 2014/0215694 | A1 * | 8/2014 | Grice | A42B 3/064 2/411 |
| 2014/0352038 | A1 * | 12/2014 | Harris | A42B 3/065 2/411 |
| 2015/0164174 | A1 * | 6/2015 | West | A42B 3/069 2/414 |
| 2016/0157544 | A1 * | 6/2016 | Ning | A42B 3/227 2/411 |
| 2016/0161222 | A1 * | 6/2016 | Lee | A42B 3/064 2/416 |
| 2017/0065018 | A1 * | 3/2017 | Lindsay | A42B 3/067 |
| 2019/0090576 | A1 * | 3/2019 | Guinta | A41D 13/0156 |
| 2019/0110545 | A1 * | 4/2019 | Lee | A42B 3/12 |

* cited by examiner

COMBAT HELMET HAVING FORCE IMPACT DISTRIBUTION

This application is a Continuation-in-Part of U.S. patent application Ser. No. 15/844,582, filed on Dec. 17, 2017, which is a Continuation-in-Part of U.S. patent application Ser. No. 14/725,817 filed on May 29, 2015, each application is incorporated herein by reference in its entirety.

BACKGROUND OF THE INVENTION

1. Field of the Invention

The present invention relates to a military combat helmet that has an architecture that helps distribute an impact force occasioned onto the helmet across a relatively large surface area of the helmet in order to reduce the possibility of a user of the helmet suffering a concussion and/or head related injury, including micro-traumatic brain injury.

2. Background of the Prior Art

Far removed from the muddy trench warfare of World War I, the modern combat soldier is a high-tech fighting machine who comes equipped with numerous advanced technologically sophisticated implements. Some combat equipment is primarily offensive and is designed for issuing violence upon the enemy while other equipment is primarily defensive and is designed for protection of the soldier from the enemy.

One of the oldest items of personal protective equipment used by combat soldiers is the helmet. Helmet usage can be traced back as far as the 23$^{rd}$ century BC when the Akkadians and Sumerians used crude head protection. Initially, helmets were constructed from leather and brass and then bronze and iron during the bronze and iron ages. Eventually, after the middle of the 10$^{th}$ century, most helmets were made from forged steel and were designed to protect a wearer's head from sword blows, arrows and even early musketry. Beginning in the late 17$^{th}$ century, the use of combat helmets fell out of favor due to the helmet's inability to protect against then-modern rifled bullets for which the helmets could not offer any meaningful protection. However, during World War I, with the increased use of artillery, helmets again became a mainstay of the combat soldier as the forged steel helmets offered protection against shrapnel and fragments. In the latter part of the 20$^{th}$ century and into the 21$^{st}$ century, significant technical advances have been made in combat helmet design and construction. Helmets are no longer made of forged steel, but are instead made from ballistic rated material, namely aramid fibers such as KEVLAR or TWARON, with a PVB-phenolic resin. Such ballistic rated fiber-based helmets—the United States military version referred to as the Advanced Combat Helmet—offer many advantages relative to their forged steel counterparts. Ballistic fiber-based combat helmets are lighter and thus more comfortable to wear, especially over protracted periods of time and can stop many pistol rounds and even certain rifle rounds as well as protect the wearer from concussive shock waves caused by explosions.

Currently the United States military is transitioning to the so-called Enhanced Combat Helmet, a term coined by Army Lieutenant Colonel William Schaffer. The Enhanced Combat Helmet is made from ultra-high-molecular-weight polyethylene and is thicker than the Advanced Combat Helmet and offers superior protection against all threats to the wearer relative to the Advanced Combat Helmet.

The Enhanced Combat Helmet as well as its predecessor the Advanced Combat Helmet are complex designs that offer penetration resistance that is far superior relative to the more primitive forged steel helmets used up through about the mid-20$^{th}$ century. While such modern helmets cannot stop every penetration threat, many threats are repelled and the wearer lives on for another day. While modern helmets have saved countless lives that would have otherwise been lost had the wearer been equipped with a forged steel helmet, the current state of the art combat helmets have limitations.

For example, an Enhanced Combat Helmet is designed to prevent a handgun round from penetrating the helmet, and thus saving the life of the wearer. However, even such a small arm round carries substantial kinetic energy, which energy is absorbed by the helmet, particularly at the point of impact. Much of the energy is transferred into the inner space of the helmet and thus transferred to the wearer, again, primarily at the point of impact. While this transfer of energy to the wearer may not kill the soldier, the impacting round still inflicts harm onto the wearer. In some cases, the incoming round can cause skull fracture especially if the round is a relatively large caliber or comes in particularly hot. More frequently, such impacts cause severe jarring of the brain which often leads to traumatic brain injury which results from brain tissue and blood vessels being stretched, compressed and torn at the impact site.

Traumatic brain injury is classified by mild, moderate or severe using the Glasgow Coma Scale or other classification system. While those suffering from mild or even moderate traumatic brain injury may, over time, fully recover and lead normal lives, such is not necessarily the case with those who suffer severe traumatic brain injury. Some soldiers who suffer severe traumatic brain injury, which may be occasioned from a blow to their head via their combat helmet, may deteriorate as time progresses, sometimes to the point of the injury being fatal, weeks or even months after the impact. Many soldiers who suffer moderate and severe traumatic brain injury are faced with problems in social behavior, emotion regulation, olfaction, and decision making, and less often may suffer from hemiparesis or aphasia. Often such deficits are chronic, leading to a lower quality of life for the sufferer.

What is needed is a system that helps spread the energy caused by an object impacting onto the combat helmet so that the impact is not localized. Such energy diffusion can help prevent severe localized damage to the wearer's brain so that hopefully the wearer does not suffer traumatic brain injury and if the wearer does so suffer, that the injury is less severe relative to the injury that may result from a focused, narrow point of impact. Such a system must not otherwise reduce the penetration prevention effectiveness or other aspects of the combat helmet such as the wearer's ability to use camouflage fabric with the helmet or the ability to attach peripherals, such as communication gear and night vision goggles, to the helmet.

SUMMARY OF THE INVENTION

The combat helmet having force impact distribution of the present invention addresses the aforementioned needs in the art by providing a combat helmet, made from any appropriate material such as ultra-high-molecular-weight polyethylene, wherein the outer shell of the helmet has force distribution capabilities so as to help diffuse the energy imparted onto the helmet from an impact with an object, such as a bullet, fragmentation, shrapnel, etc., so as to help prevent severe localized injury to the wearer's head and thus their brain. The combat helmet having force impact distribution changes the geometry of the outer shell of the helmet without the need to alter the inner architecture (chin straps, sweatbands, nape straps, bales, suspension webbing, etc.) of the helmet. The combat helmet having force impact distribution is of relatively simple design and construction, being produced using standard manufacturing techniques for combat helmets, so as to make the present invention relatively inexpensive to produce so as to make the helmet economically attractive to potential consumers of the device. The combat helmet having force impact distribution is worn and used in standard fashion by a soldier in the field.

The combat helmet having force impact distribution of the present invention is comprised of a helmet body that has an outer shell. that itself has a first overall outer surface and a first overall inner surface. The outer shell has a crown and a lower section. At least a portion of the first overall outer surface is formed as a faceted region made from a series of adjoining facets such that each facet has a second outer surface that is a subset of the first overall outer surface and that has a convex contour. The helmet shell is formed from a ballistic rated material. A chin strap is attached to the helmet shell, the chin strap configured as either an X-Back retention system or an H-Back retention system. The portion of the helmet shell having the faceted region may be the crown section and excludes the lower section or may be the lower section and excludes the crown section or may be both the crown section and the lower section. The outer shell may a constant thickness so that the inner surface of the helmet shell would have concave contoured facets that correspond to the convex contoured facets located on the outer surface of the helmet shell. The ballistic material used to form the helmet shell may be either ultra-high-molecular-weight polyethylene material or advanced aramid fiber material. At least one attachment mount may be located on the first overall outer surface of the helmet shell.

BRIEF DESCRIPTION OF THE DRAWINGS

Similar reference numerals refer to similar parts throughout the several views of the drawings.

DESCRIPTION OF THE PREFERRED EMBODIMENT

Figure 1:
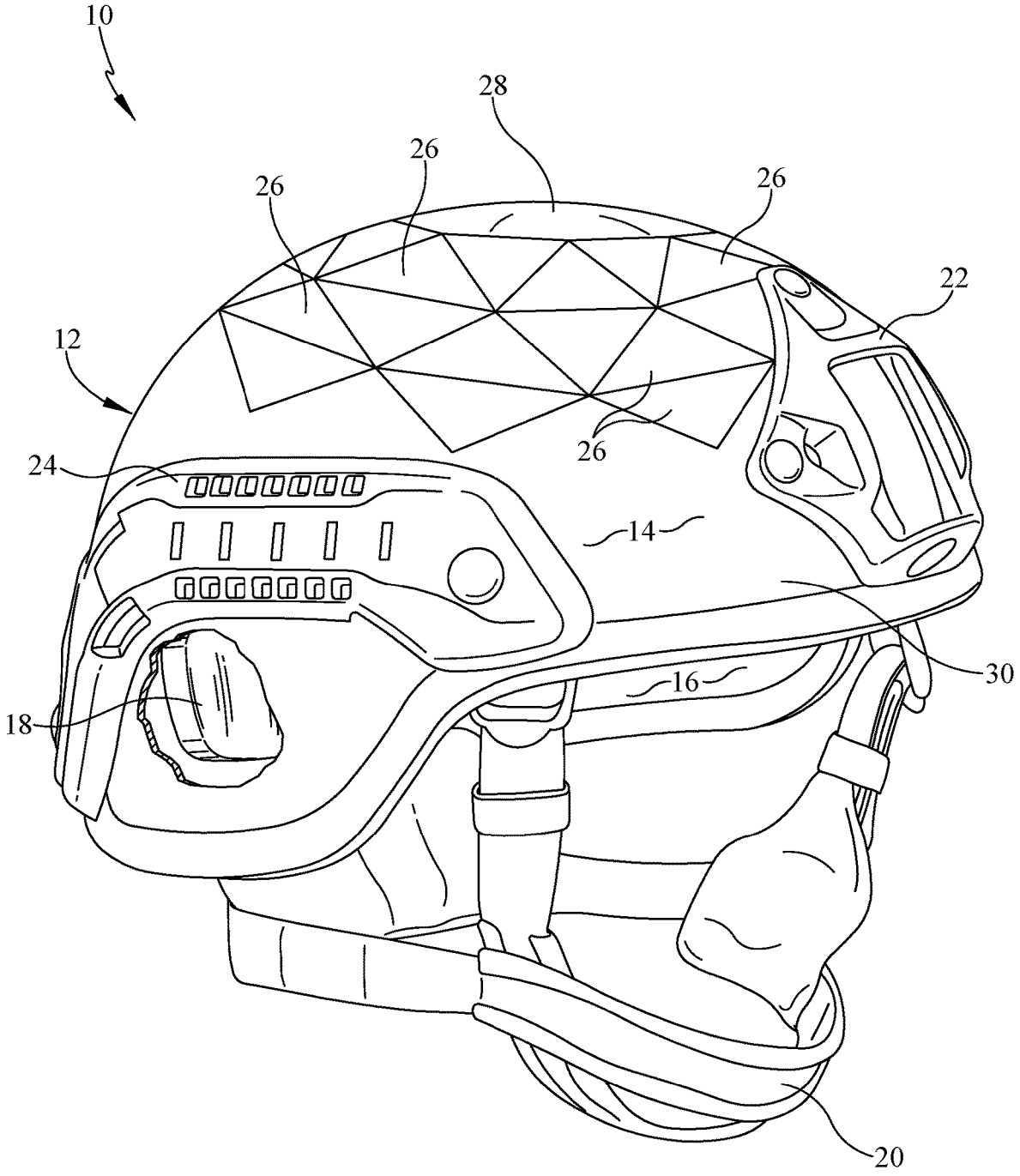
FIG. 1 is a perspective view, partially cutaway, of the combat helmet having force impact distribution of the present invention wherein the faceted region is located only on the crown section of the helmet.

Referring now to the drawings, it is seen that the combat helmet having force impact distribution of the present invention, generally denoted by reference numeral 10, is comprised of a helmet body that has a helmet shell 12 that has an overall outer surface 14 and an overall inner surface 16. An appropriate suspension system 18 is located within the interior area of the helmet shell 12 attached as appropriate to the inner surface 16 of the helmet shell 12. As seen, the combat helmet having force impact distribution 10 has an appropriate chin strap 20 which may be an X-Back retention system or an H-Back retention system or other appropriate retention system.

The helmet shell 12 is formed from a ballistic rated material so that it is highly resistant to penetration from small arms and rifle projectiles commonly found on the battlefield (the helmet shell 12 must be able to pass a v50 test for such projectiles) as well as from much of the fragmentation which can impact the combat helmet having force impact distribution 10 during combat. While the helmet shell 12 of the combat helmet having force impact distribution 10 may be made from ballistic nylon or original aramid fabrics, advantageously, the helmet shell 12 is made from ultra-high-molecular-weight polyethylene, the material used to produce the Enhanced Combat Helmet, or advanced aramid fibers used to produce the FAST/High Cut/Maritime cut/ATE® each used by the United States military. The combat helmet having force impact distribution 10 may be full cut, tactical cut, as shown, or above the ear cut as noted. As seen, appropriate front mounts 22 and side mounts 24 may be located on the outer surface 14 of the helmet shell 12 in order to allow mounting of various items, such as night vision gear, telecommunications equipment, etc. Camouflage covers can also be deployed onto the combat helmet having force impact distribution 10.

As seen, instead of having a relative smooth rounded outer surface of a typical combat helmet such as the Enhanced Combat helmet or the FAST/High Cut/Maritime cut/ATE®, at least a portion of its outer surface 14 of the helmet shell 12 is formed as a series of connected faceted regions of various geometry such as the illustrated triangular shaped facets 26. The size of each type of facet 26 may but need not be of the same. Additionally, other shapes of facets can be used and more than one shape of facets can be employed on a given helmet shell 12.

The outer surface of each of the individual facet 26 is slightly convex. The helmet shell 12 may have a relative constant thickness wherever the facets 26 are located so that the inner surface 16 of the helmet shell 12 also has the faceted regions corresponding to the faceted regions on the outer surface 14 of the helmet shell 12, with the facets on the inner surface 16 of the helmet shell 12 being slightly concave in order to match the convex contouring of the outer surface of the particular faceted region. By utilizing a constant thickness of the faceted regions of the helmet shell 12, impacts on the helmet shell 12 allow relatively smooth deflection of forces impacted onto the outer surface 14 of the helmet shell 12 with the slight convexity of the outer surface of each faceted region assisting in such force deflection. However, the faceted regions may be located only on the outer surface 14 of the helmet shell 12 and that faceted shaping need not necessarily transfer into the inner surface 16 of the helmet shell.

Figure 2:
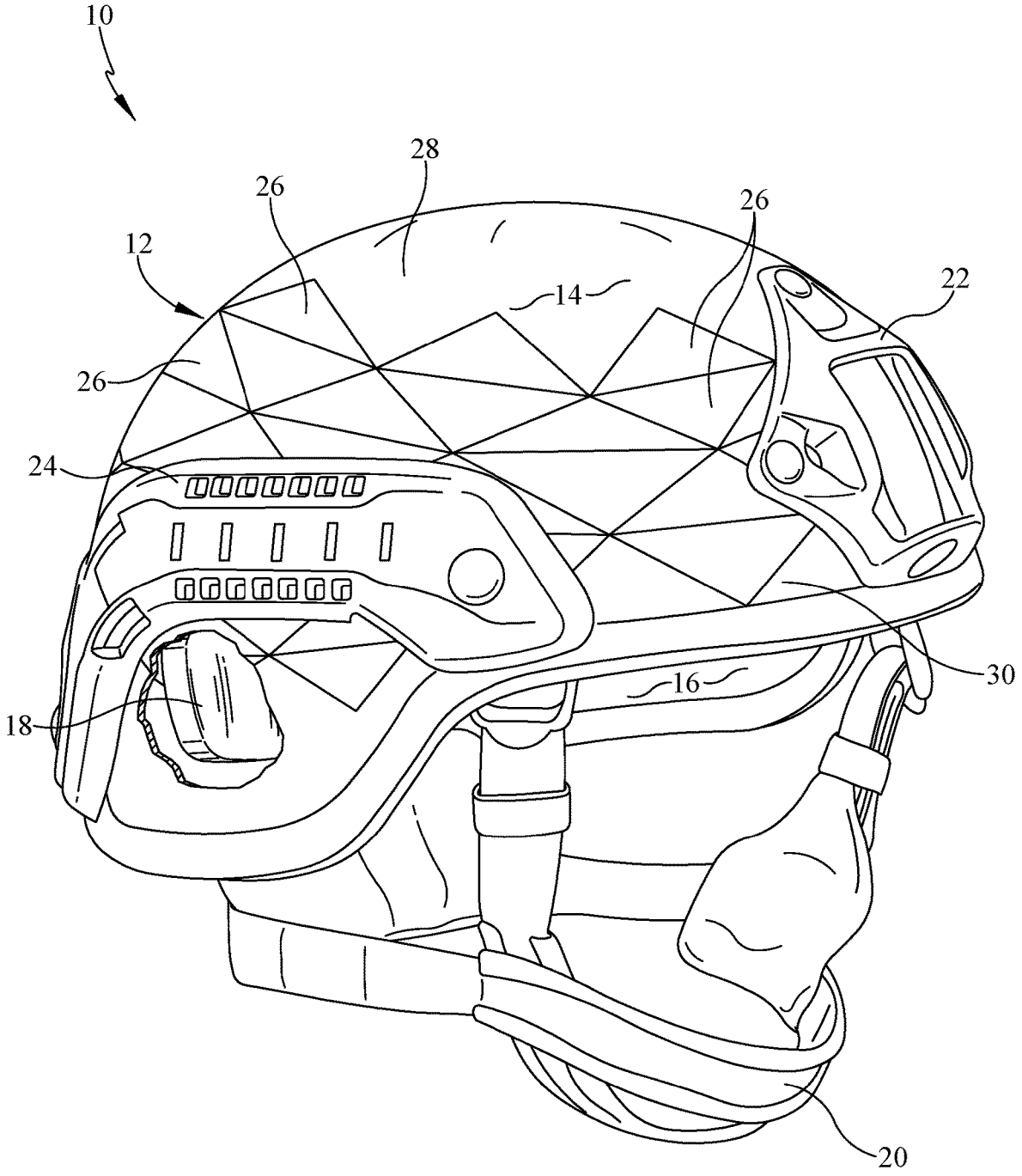
FIG. 2 is a perspective view, partially cutaway, of the combat helmet having force impact distribution employing wherein the faceted regions cover both the lower section and the crown section of the outer shell of the helmet.
Figure 3:
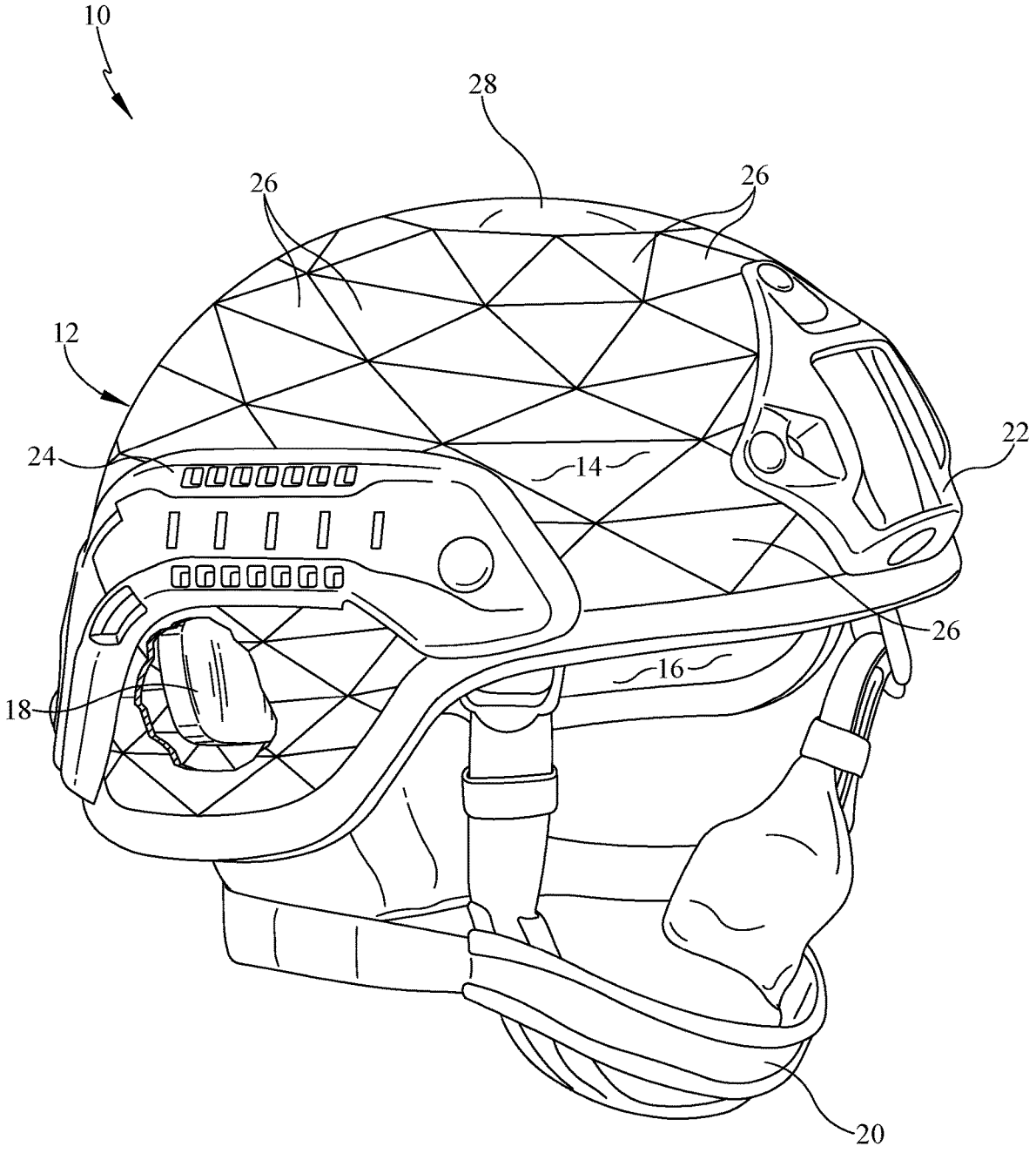
FIG. 3 is a perspective view, partially cutaway, of the combat helmet having force impact distribution employing wherein the faceted region is located only the lower section of the outer shell of the helmet.

The faceted regions can be confined to the crown section 28 of the helmet shell 12—roughly the upper half of the helmet shell 12—or the lower the lower section 30 of the helmet shell 12, or, as seen in FIG. 2, substantially the entire helmet shell 12 can be covered with the facets 26.

The faceted regions are an integral part of the helmet shell 12, that is, they are not attached or otherwise secured to the outer surface 14 of the helmet shell 12, rather, the faceted regions are manufactured as part of the helmet shell formation.

When a force is imparted onto one or more faceted regions on the outer surface 14 of the helmet shell 12, the force is spread or transferred to many of the adjoining facets 26 and possibly to a portion of the non-faceted portion(s) of the helmet shell 12 (if the helmet shell 12 is so designed) so as to spread the force over a relatively larger surface area so that the force that is transferred through the helmet shell 12 into the interior of the helmet shell 12 is spread over a relatively large surface area thereby reducing the localization of the helmet shell penetrating force and reducing the risk and severity of injury to the wearer.

In essence, the present invention reduces the force imparted to the helmet wearer by increasing impact deflection while reducing the reflection.

While the invention has been particularly shown and described with reference to an embodiment thereof, it will be appreciated by those skilled in the art that various changes in form and detail may be made without departing from the spirit and scope of the invention.

I claim:

1. A helmet configured to be worn on a human head, the helmet comprising:

a helmet body having a helmet shell the helmet shell having a first overall outer surface and a first overall inner surface, the helmet shell also having a crown and a lower section, such that at least a portion of the first overall outer surface of the helmet shell is formed as a faceted region made from a series of adjoining facets such that each facet has a second outer surface that is a subset of the first overall outer surface and each facet has a convex contour and wherein the helmet shell is formed from a ballistic rated material; and a chin strap attached to the helmet shell, the chin strap configured as either an X-Back retention system or an H-Back retention system.

2. The helmet as in claim 1 wherein the portion of the helmet shell having the faceted region is the crown section and excludes the lower section.

3. The helmet as in claim 1 wherein the portion of the helmet shell having the faceted region is the lower section and excludes the crown section.

4. The helmet as in claim 1 wherein the portion of the helmet shell having the faceted region is the both the crown section and the lower section.

5. The helmet as in claim 1 wherein the outer shell has a constant thickness.

6. The helmet as in claim 1 wherein the ballistic material is from ultra-high-molecular-weight polyethylene material.

7. The helmet as in claim 1 wherein the ballistic material is from advanced aramid fiber material.

8. The helmet as in claim 1 wherein the ballistic material is from either ultra-high-molecular-weight polyethylene material or advanced aramid fiber material.

9. The helmet as in claim 1 further comprising an attachment mount located on the first overall outer surface of the helmet shell.

10. A helmet configured to be worn on a human head, the helmet comprising:

a helmet body that has an outer shell having a first overall outer surface and a first overall inner surface and has a crown and a lower section, such that at least a portion of the first overall outer surface is formed as a series of adjoining polygon-shaped facets and such that the adjoining polygon-shaped facets extend through the helmet body to the first overall inner surface and such that each facet has a second outer surface that is a subset of the first overall outer surface and that has a convex contour and each facet has a second inner surface that is a subset of the first overall inner surface and that has a concave contour that corresponds to the convex contour of the second outer surface and wherein the helmet shell is formed from a ballistic rated material; and a chin strap attached to the helmet shell, the chin strap configured as either an X-Back retention system or an H-Back retention system.

11. The helmet as in claim 10 wherein the portion of the helmet shell having the faceted region is the crown section and excludes the lower section.

12. The helmet as in claim 10 wherein the portion of the helmet shell having the faceted region is the lower section and excludes the crown section.

13. The helmet as in claim 10 wherein the portion of the helmet shell having the faceted region is the both the crown section and the lower section.

14. The helmet as in claim 10 wherein the outer shell has a constant thickness.

15. The helmet as in claim 10 wherein the ballistic material is from ultra-high-molecular-weight polyethylene material.

16. The helmet as in claim 10 wherein the ballistic material is from advanced aramid fiber material.

17. The helmet as in claim 10 wherein the ballistic material is from either ultra-high-molecular-weight polyethylene material or advanced aramid fiber material.

18. The helmet as in claim 10 further comprising an attachment mount located on the first overall outer surface of the helmet shell.

* * * * *